US006732450B1

(12) United States Patent
Chen

(10) Patent No.: US 6,732,450 B1
(45) Date of Patent: May 11, 2004

(54) ELECTROTHERMAL RACK OF HAIR DRYER

(76) Inventor: Shu-Lien Chen, P.O. Box 55-124, Taichung (TW)

( * ) Notice: Subject to any disclaimer, the term of this patent is extended or adjusted under 35 U.S.C. 154(b) by 0 days.

(21) Appl. No.: 10/616,931

(22) Filed: Jul. 11, 2003

(51) Int. Cl.[7] ..... A45D 20/10

(52) U.S. Cl. ..... 34/96; 34/97; 392/383; 392/385; 338/282; 338/305

(58) Field of Search ..... 34/96, 97, 98; 392/380, 383, 384, 385; 338/282, 305

(56) References Cited

U.S. PATENT DOCUMENTS 2,502,044 A * 3/1950 Isaacson ..... 338/321
4,196,343 A * 4/1980 Han ..... 392/385
4,230,933 A * 10/1980 Glucksman et al. ..... 338/302
4,668,855 A * 5/1987 Wilson et al. ..... 392/385

FOREIGN PATENT DOCUMENTS

EP 338604 A1 * 10/1989 ..... H05B/3/16

* cited by examiner

*Primary Examiner*—Jiping Lu

(57) ABSTRACT

An electrothermal rack of a hair dryer includes a main body including a plurality of support wings each having a mediate portion formed with a positioning section formed with a plurality of inner insertion recesses. Each of the support wings has an outer side formed with a protruding plate formed with a plurality of outer insertion recesses. Each of the support wings is formed with a slideway between the positioning section and the protruding plate. Thus, the electrothermal body forms a multi-loop inner layer and a multi-loop outer layer around the support wings to increase the heating area of the electrothermal rack, thereby enhancing the heating efficiency of the hair dryer.

15 Claims, 5 Drawing Sheets

ELECTROTHERMAL RACK OF HAIR DRYER

BACKGROUND OF THE INVENTION

1. Field of the Invention

The present invention relates to an electrothermal rack of a hair dryer, and more particularly to an electrothermal rack of a hair dryer having a greater heating efficiency.

2. Description of the Related Art

A conventional electrothermal rack of a hair dryer in accordance with the prior art shown in FIGS. 1–3 comprises a plurality of positioning plates 1 each mounted in the air outlet pipe 4 of the hair dryer and each formed with a plurality of recesses 2, and an electrothermal body 3 wound around each of the positioning plates 1 and received in each of the recesses 2 of each of the positioning plates 1. Thus, the electrothermal body 3 forms a multi-loop layer.

However, each of the positioning plates 1 has a uniform width, so that the loops of the electrothermal body 3 interfere with each other in the axial direction of the airflow, thereby decreasing the heating efficiency of the hair dryer. In addition, the electrothermal body only has a single multi-loop layer so that the heating area of the electrothermal rack is not large enough, thereby decreasing the heating efficiency of the hair dryer.

SUMMARY OF THE INVENTION

The present invention is to mitigate and/or obviate the disadvantage of the conventional electrothermal rack of a hair dryer.

The primary objective of the present invention is to provide an electrothermal rack of a hair dryer, wherein the electrothermal body forms a multi-loop inner layer and a multi-loop outer layer around the support wings of the main body so as to increase the heating area of the electrothermal rack of the hair dryer, thereby enhancing the heating efficiency of the hair dryer.

Another objective of the present invention is to provide an electrothermal rack of a hair dryer, wherein the electrothermal body forms a plurality of loops which are arranged in a staggered manner without interfering with each other, so that the air modules can be heated smoothly and evenly, thereby producing a stable and uniform air flow when blown outward from the hair dryer.

A further objective of the present invention is to provide an electrothermal rack of a hair dryer, wherein the electrothermal body forms a multi-loop inner layer and a multi-loop outer layer, so that the electrothermal body has a greater length. Thus, the longer electrothermal body has a smaller heating rate per unit volume, so that the electrothermal body is not easily fused or worn out, thereby increasing the lifetime of the electrothermal body.

In accordance with the present invention, there is provided an electrothermal rack of a hair dryer, comprising a main body including a plurality of support wings, wherein:

- each of the support wings has a mediate portion formed with a positioning section;
- the positioning section of each of the support wings has an outer side formed with a plurality of inner insertion recesses;
- each of the support wings has an outer side formed with an elongated protruding plate;
- the protruding plate of each of the support wings has an outer side formed with a plurality of outer insertion recesses; and
- each of the support wings is formed with an elongated slideway which is defined between the outer side of the positioning section and the inner side of the protruding plate.

Further benefits and advantages of the present invention will become apparent after a careful reading of the detailed description with appropriate reference to the accompanying drawings.

DETAILED DESCRIPTION OF THE INVENTION

Figure 1:
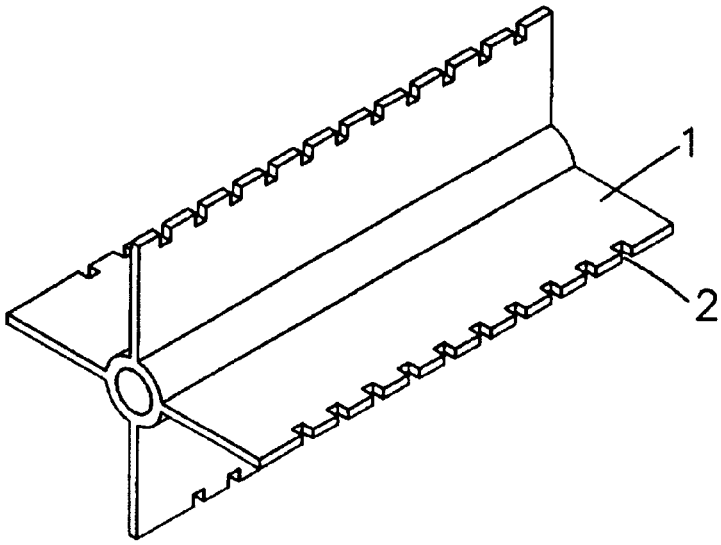
FIG. 1 PRIOR ART
FIG. 1 is a perspective view of a conventional electrothermal rack of a hair dryer in accordance with the prior art.
Figure 3:
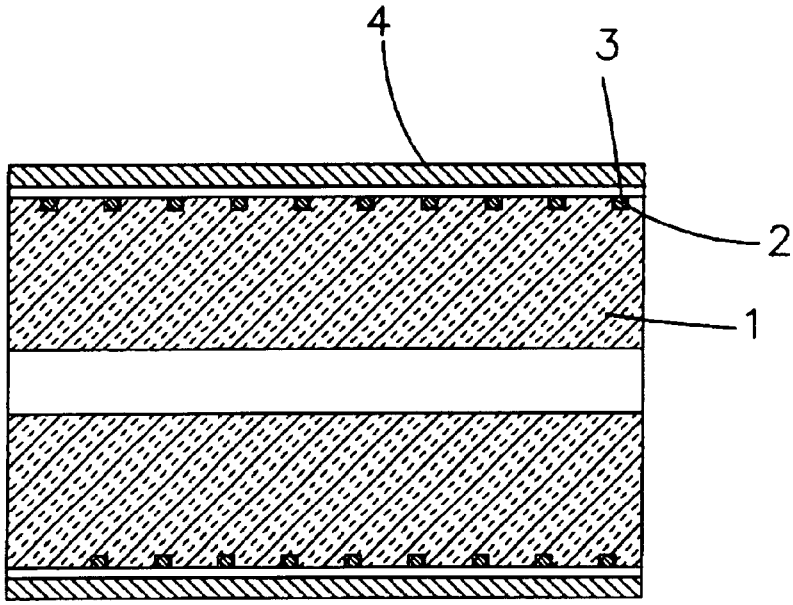
FIG. 3 PRIOR ART
FIG. 3 is a side plan cross-sectional view of the conventional electrothermal rack of a hair dryer as shown in FIG. 2.
Figure 2:
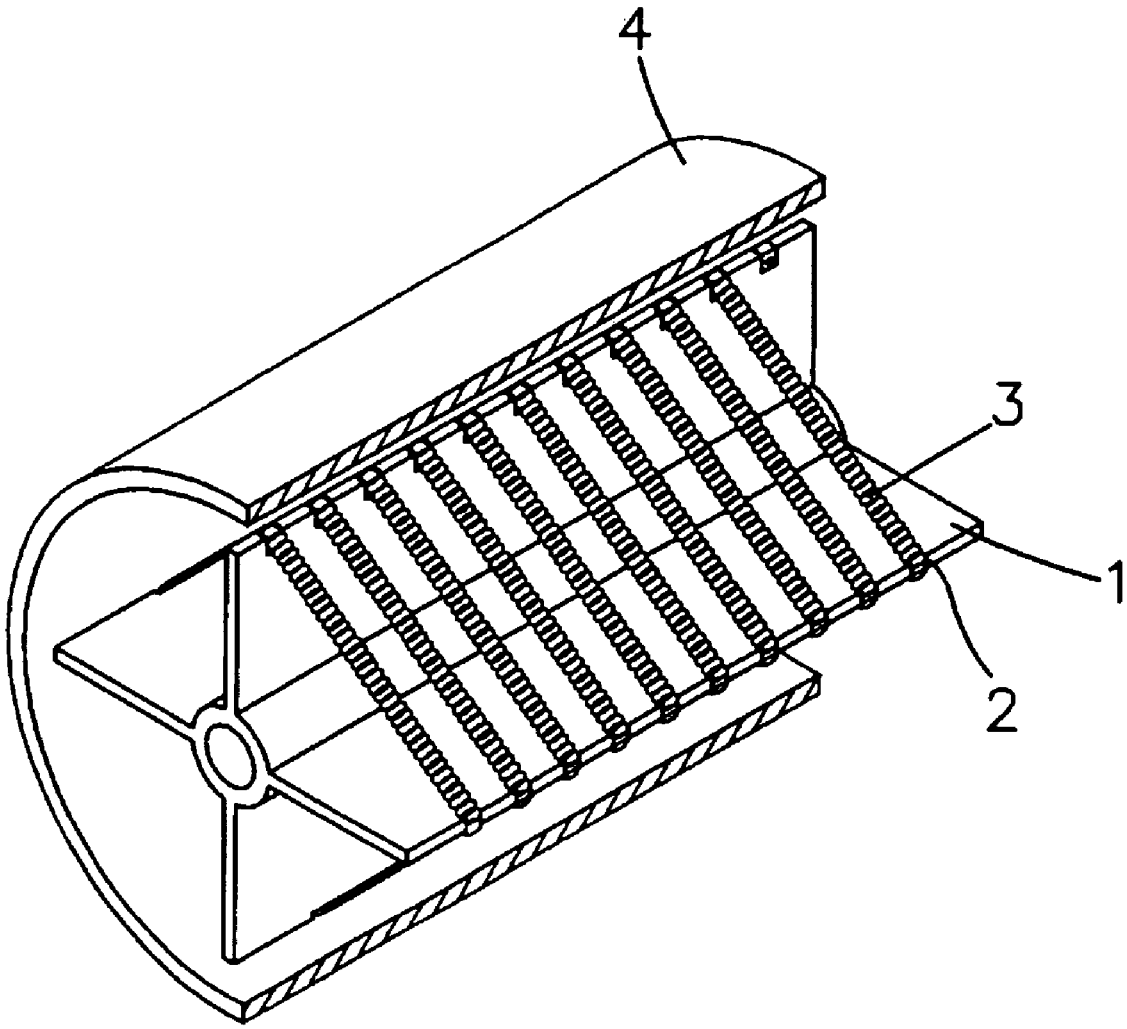
FIG. 2 PRIOR ART
FIG. 2 is a perspective assembly view of the conventional electrothermal rack of a hair dryer in accordance with the prior art.
Figure 4:
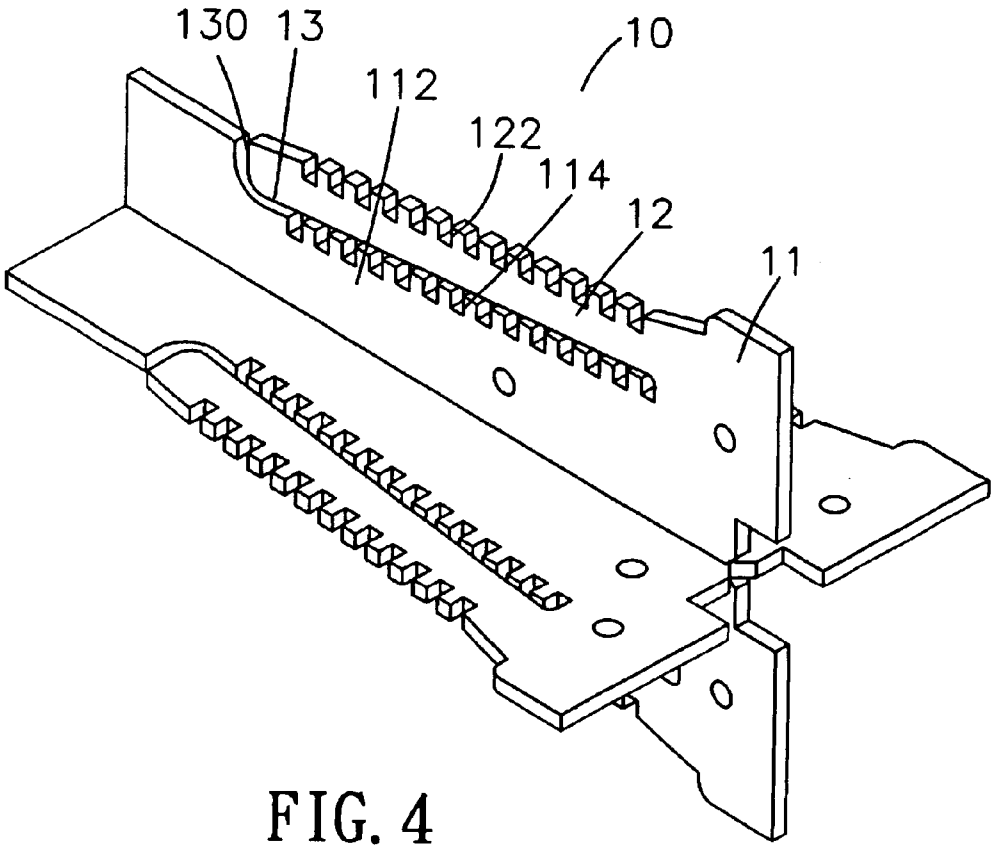
FIG. 4 is a perspective view of an electrothermal rack of a hair dryer in accordance with the preferred embodiment of the present invention.

Referring to the drawings and initially to FIGS. 4–7, an electrothermal rack of a hair dryer in accordance with the preferred embodiment of the present invention comprises a main body 10 including a plurality of support wings 11. Preferably, the main body 10 includes four support wings 11 each extending outward in a radiating manner.

Each of the support wings 11 has a mediate portion formed with a positioning section 112. The positioning section 112 of each of the support wings 11 has a first end and a second end and has a thickness gradually increased from the first end to the second end thereof, so that the positioning section 112 of each of the support wings 11 has a tapered configuration. In addition, the positioning section 112 of each of the support wings 11 has an outer side formed with a plurality of inner insertion recesses 114.

Each of the support wings 11 has an outer side formed with an elongated protruding plate 12. The protruding plate 12 of each of the support wings 11 is extended along the outer side of the positioning section 112 and has a first end integrally extended from each of the support wings 11. The protruding plate 12 of each of the support wings 11 has an outer side formed with a plurality of outer insertion recesses 122. In addition, the outer side of the protruding plate 12 has a tapered configuration and is in parallel with the outer side of the positioning section 112.

Each of the support wings 11 is formed with an elongated slideway 13 which is defined between the outer side of the positioning section 112 and the inner side of the protruding plate 12. The slideway 13 of each of the support wings 11 communicates with each of the inner insertion recesses 114 of the positioning section 112. The slideway 13 of each of the support wings 11 has a distal end formed with an opening 130 extended through a second end of the protruding plate 12 and connected to the ambient environment.

In assembly, a strip shaped electrothermal body 90 is mounted on the main body 10. Then, the electrothermal body 90 is extended through the opening 130 into the slideway 13 and is inserted into and rested on the inner insertion recess 114 of the positioning section 112 of each of the support wings 11. In such a manner, the electrothermal body 90 is in turn wound around each of the inner insertion recesses 114 of the positioning section 112 of each of the support wings 11 to form a plurality of loops, so that the electrothermal body 90 forms a multi-loop inner layer around the positioning section 112 of each of the support wings 11. Then, the electrothermal body 90 is in turn wound around each of the outer insertion recesses 122 of the protruding plate 12 of each of the support wings 11 to form a plurality of loops, so that the electrothermal body 90 forms a multi-loop outer layer around the protruding plate 12 of each of the support wings 11.

Figure 6:
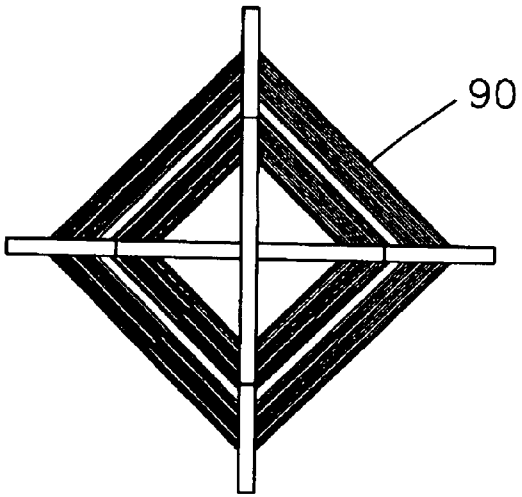
FIG. 6 is a plan view of the electrothermal rack of a hair dryer as shown in FIG. 5.
Figure 5:
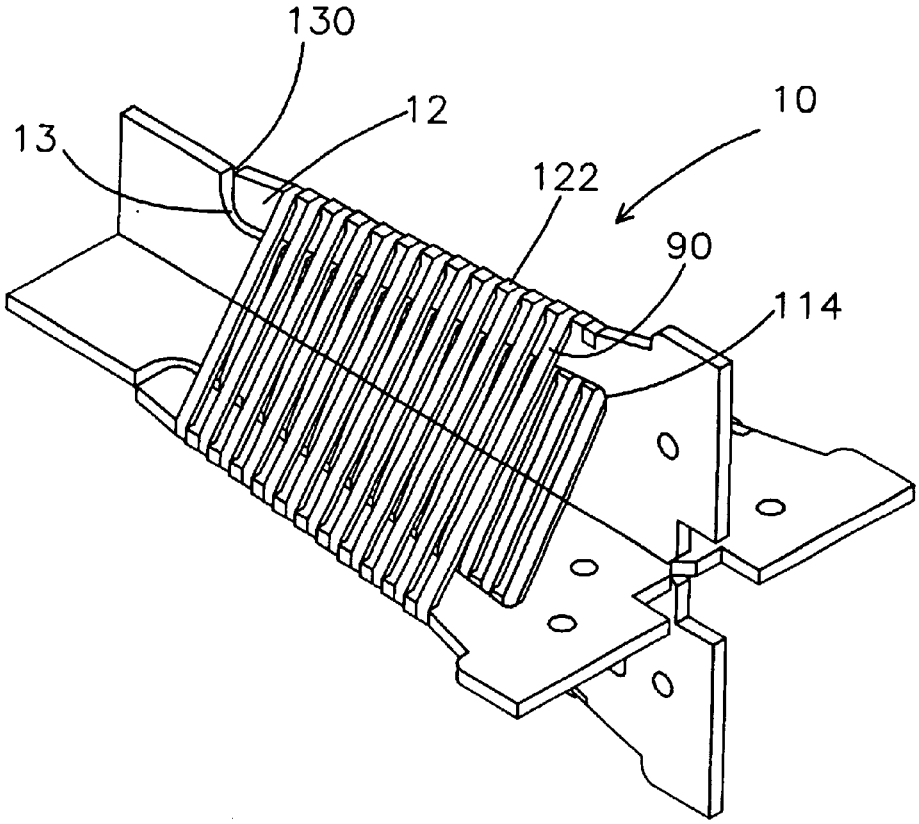
FIG. 5 is a perspective assembly view of the electrothermal rack of a hair dryer in accordance with the preferred embodiment of the present invention.
Figure 7:
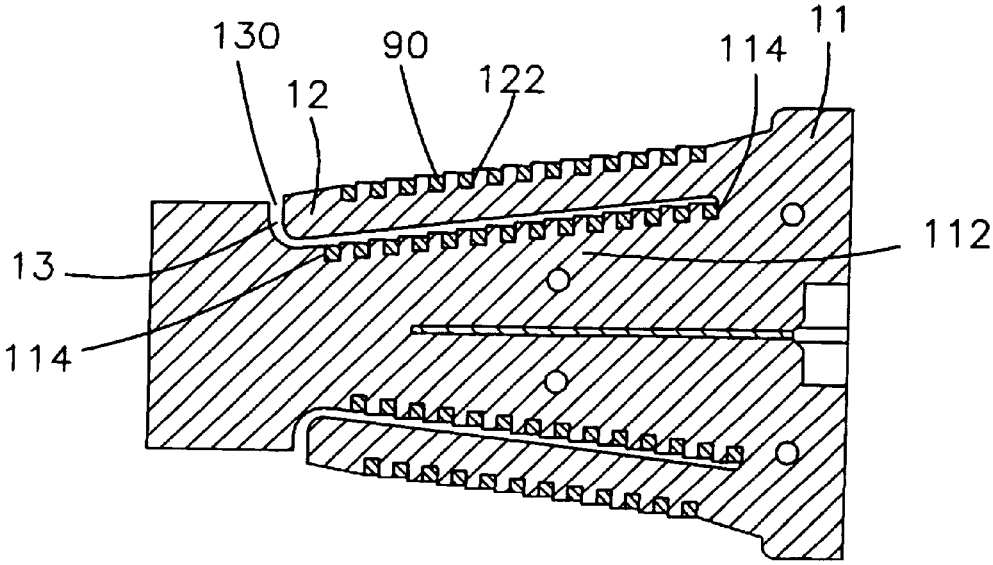
FIG. 7 is a side plan cross-sectional view of the electrothermal rack of a hair dryer as shown in FIG. 5.

Thus, the electrothermal body 90 forms a multi-loop inner layer and a multi-loop outer layer around the support wings 11 of the main body 10 as shown in FIGS. 5 and 6.

Accordingly, the electrothermal body 90 forms a multi-loop inner layer and a multi-loop outer layer around the support wings 11 of the main body 10 so as to increase the heating area of the electrothermal rack of the hair dryer, thereby enhancing the heating efficiency of the hair dryer. In addition, the electrothermal body 90 forms a plurality of loops which are arranged in a staggered manner without interfering with each other, so that the air modules can be heated smoothly and evenly, thereby producing a stable and uniform air flow when blown outward from the hair dryer. Further, the electrothermal body 90 forms a multi-loop inner layer and a multi-loop outer layer, so that the electrothermal body 90 has a greater length. Thus, the longer electrothermal body 90 has a smaller heating rate per unit volume, so that the electrothermal body 90 is not easily fused or worn out, thereby increasing the lifetime of the electrothermal body 90.

Figure 8:
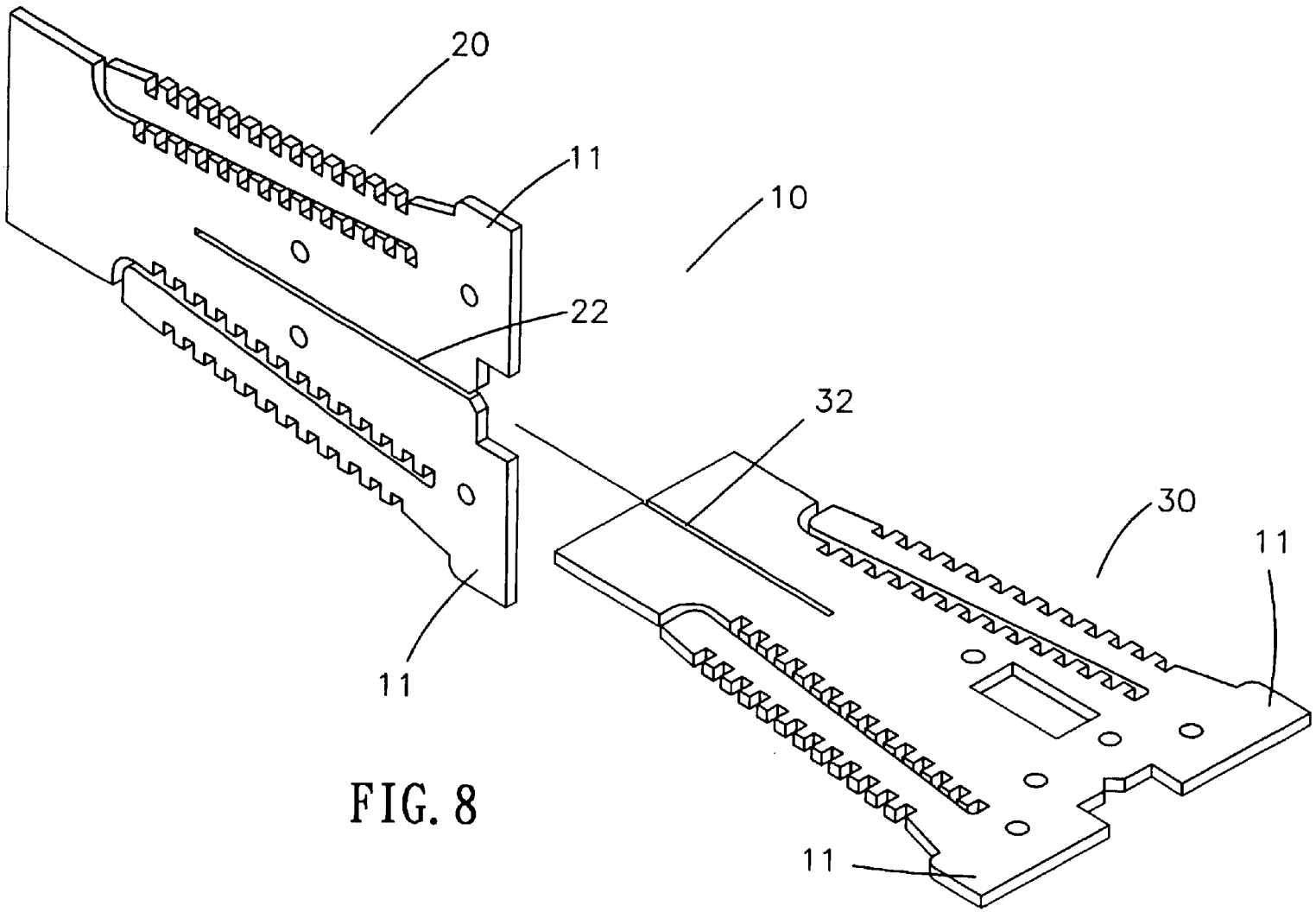
FIG. 8 is an exploded perspective view of the electrothermal rack of a hair dryer as shown in FIG. 4.

Referring to FIG. 8, the main body 10 includes a first board 20 and a second board 30 combined with each other. Each of the first board 20 and the second board 30 has two sides each formed with the support wing 11. The first board 20 has an end having a center formed with a first insertion slot 22, and the second board 30 has an end having a center formed with a second insertion slot 32. The total length of the first insertion slot 22 and the second insertion slot 32 is equal to the axial length of the first board 20 and the second board 30. Thus, the second board 30 is inserted into the first insertion slot 22 of the first board 20, and the first board 20 is inserted into the second insertion slot 32 of the second board 30, thereby forming the main body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An electrothermal rack of a hair dryer, comprising a main body including a plurality of support wings, wherein:

each of the support wings has a mediate portion formed with a positioning section;

the positioning section of each of the support wings has an outer side formed with a plurality of inner insertion recesses;

each of the support wings has an outer side formed with an elongated protruding plate;

the protruding plate of each of the support wings has an outer side formed with a plurality of outer insertion recesses; and each of the support wings is formed with an elongated slideway which is defined between the outer side of the positioning section and the inner side of the protruding plate.

2. The electrothermal rack of a hair dryer in accordance with claim 1, wherein the main body includes four support wings each extending outward in a radiating manner.

3. The electrothermal rack of a hair dryer in accordance with claim 1, wherein the positioning section of each of the support wings has a first end and a second end and has a thickness gradually increased from the first end to the second end thereof, so that the positioning section of each of the support wings has a tapered configuration.

4. The electrothermal rack of a hair dryer in accordance with claim 3, wherein the outer side of the protruding plate has a tapered configuration and is in parallel with the outer side of the positioning section.

5. The electrothermal rack of a hair dryer in accordance with claim 1, wherein the protruding plate of each of the support wings is extended along the outer side of the positioning section and has an end integrally extended from each of the support wings.

6. The electrothermal rack of a hair dryer in accordance with claim 1, wherein the slideway of each of the support wings communicates with each of the inner insertion recesses of the positioning section.

7. The electrothermal rack of a hair dryer in accordance with claim 1, wherein the slideway has a distal end formed with an opening extended through a distal end of the protruding plate and connected to the ambient environment.

8. The electrothermal rack of a hair dryer in accordance with claim 7, further comprising an electrothermal body mounted on the main body, the electrothermal body is extended through the opening into the slideway and is inserted into and rested on the inner insertion recess of the positioning section of each of the support wings.

9. The electrothermal rack of a hair dryer in accordance with claim 8, wherein the electrothermal body is in turn wound around each of the inner insertion recesses of the positioning section of each of the support wings to form a plurality of loops, so that the electrothermal body forms a multi-loop inner layer around the positioning section of each of the support wings.

10. The electrothermal rack of a hair dryer in accordance with claim 8, wherein the electrothermal body is in turn wound around each of the outer insertion recesses of the protruding plate of each of the support wings to form a plurality of loops, so that the electrothermal body forms a multi-loop outer layer around the protruding plate of each of the support wings.

11. The electrothermal rack of a hair dryer in accordance with claim 1, wherein the main body includes a first board and a second board combined with each other.

12. The electrothermal rack of a hair dryer in accordance with claim 11, wherein each of the first board and the second board has two sides each formed with the support wing.

13. The electrothermal rack of a hair dryer in accordance with claim 11, wherein the first board has an end having a center formed with a first insertion slot, and the second board has an end having a center formed with a second insertion slot.

14. The electrothermal rack of a hair dryer in accordance with claim 13, wherein the second board is inserted into the first insertion slot of the first board, and the first board is inserted into the second insertion slot of the second board, thereby forming the main body.

15. The electrothermal rack of a hair dryer in accordance with claim 13, wherein the total length of the first insertion slot and the second insertion slot is equal to the axial length of the first board and the second board.

* * * * *